US008955833B2

(12) United States Patent
Suzuki et al.

(10) Patent No.: US 8,955,833 B2
(45) Date of Patent: Feb. 17, 2015

(54) RECORDING APPARATUS

(75) Inventors: Yuto Suzuki, Shiojiri (JP); Minoru Kishigami, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 13/406,570

(22) Filed: Feb. 28, 2012

(65) Prior Publication Data

US 2012/0217701 A1 Aug. 30, 2012

(30) Foreign Application Priority Data

Feb. 28, 2011 (JP) ..... 2011-042306
Feb. 28, 2011 (JP) ..... 2011-042315

(51) Int. Cl.

| | |
|---|---|
| ***B41J 29/13*** | (2006.01) |
| ***B41J 2/175*** | (2006.01) |
| ***B41J 29/00*** | (2006.01) |
| ***B41J 29/02*** | (2006.01) |

(52) U.S. Cl.

CPC ..... *B41J 29/13* (2013.01); *B41J 2/175* (2013.01); *B41J 29/00* (2013.01); *B41J 29/02* (2013.01)

USPC ..... 271/3.14; 347/86; 347/108

(58) Field of Classification Search

CPC ..... B65H 31/34; B65H 31/36; B65H 31/38; B65H 31/40; B65H 2301/142; B65H 2301/212

USPC ..... 271/3.14; 347/86, 108; 399/124

See application file for complete search history.

(56) References Cited

U.S. PATENT DOCUMENTS

| | | | | |
|---|---|---|---|---|
| 6,530,634 | B1 * | 3/2003 | Hara | 347/7 |
| 7,380,931 | B2 * | 6/2008 | Asanuma | 347/108 |
| 7,753,500 | B2 * | 7/2010 | Nishida | 347/84 |
| 7,988,268 | B2 * | 8/2011 | Morino | 347/84 |
| 2003/0052956 | A1 | 3/2003 | Katsuyama | |
| 2004/0125180 | A1 | 7/2004 | Koga | |
| 2004/0125181 | A1 | 7/2004 | Nakamura | |
| 2004/0234320 | A1 | 11/2004 | Yoshihara | |
| 2005/0140752 | A1 * | 6/2005 | Shiho et al. | 347/85 |
| 2005/0162486 | A1 | 7/2005 | Watarai | |
| 2005/0243148 | A1 * | 11/2005 | Miyazawa et al. | 347/86 |
| 2006/0082622 | A1 * | 4/2006 | Yonekawa et al. | 347/85 |

(Continued)

FOREIGN PATENT DOCUMENTS

| | | |
|---|---|---|
| EP | 2075131 | 7/2009 |
| JP | 05-307285 | 11/1993 |

(Continued)

OTHER PUBLICATIONS

International Search Report dated Oct. 4, 2012 for International Application No. PCT/JP2012/055502.

*Primary Examiner* — Jeremy R Severson
(74) *Attorney, Agent, or Firm* — Workman Nydegger

(57) ABSTRACT

A recording apparatus includes a case. In the case, a feeding unit configured to feed a recording medium in a feeding direction, a feeding path through which the recording medium is fed, a recording unit configured to record on the recording medium, and an ink tube connected to the recording unit and an ink cartridge for supplying ink to the recording unit are provided. A first opening is provided in a face of the case for allowing the recording medium disposed in the feeding path to be removable. A second opening is provided in the face where the first opening is provided for allowing the ink cartridge to be installed. An operating unit is provided above the first opening.

19 Claims, 5 Drawing Sheets

(56) References Cited

U.S. PATENT DOCUMENTS

| | | | | |
|---|---|---|---|---|
| 2006/0125904 | A1 | 6/2006 | Shokai | |
| 2006/0187288 | A1 | 8/2006 | Nishida | |
| 2006/0192833 | A1 | 8/2006 | Samoto et al. | |
| 2007/0077108 | A1 | 4/2007 | Kawasaki | |
| 2007/0211131 | A1* | 9/2007 | Iijima | 347/108 |
| 2007/0229625 | A1* | 10/2007 | Yano | 347/86 |
| 2007/0229628 | A1* | 10/2007 | Yano | 347/86 |
| 2007/0236552 | A1* | 10/2007 | Suzuki et al. | 347/108 |
| 2008/0246826 | A1* | 10/2008 | Yonekawa | 347/108 |
| 2009/0153631 | A1* | 6/2009 | Haung | 347/86 |
| 2009/0167834 | A1* | 7/2009 | Kuriki | 347/108 |
| 2010/0066796 | A1* | 3/2010 | Yanagi et al. | 347/108 |

FOREIGN PATENT DOCUMENTS

| | | |
|---|---|---|
| JP | 09-094945 | 4/1997 |
| JP | 11-095627 | 4/1999 |
| JP | 2000-019885 | 1/2000 |
| JP | D1129074 | 10/2001 |
| JP | D1129075 | 10/2001 |
| JP | D1130131 | 11/2001 |
| JP | 2003-175588 | 6/2003 |
| JP | 2004-58370 | 2/2004 |
| JP | 2004-264518 | 9/2004 |
| JP | 2006-231560 | 9/2006 |

* cited by examiner

RECORDING APPARATUS

BACKGROUND

The present invention relates to a recording apparatus having an opening provided for removing a recording medium jammed in a path through which the recording medium is fed, and a cover that covers the opening.

In the present specification, the recording apparatus includes types of an ink jet printer, a wire dot printer, a laser printer, a line printer, a copying machine, and a facsimile.

JP-A-05-307285 is an example of related art. An image forming apparatus of the related art includes a transport unit, a transport path, a case, the opening, and the cover. Among those components, the transport unit has a roller to transport a recording paper in a feeding direction. Also, the transport path is configured to guide the recording paper in the feeding direction. Furthermore, the case is so designed as to cover an entire of the image forming apparatus. Also, the opening is provided on a top face of the case. Also, the cover is so designed as to cover the opening in openable and closable manner in the top face of the case.

The image forming apparatus is configured so that a user opens the cover and inserts a hand into the case through the opening so as to remove the recording paper in a case where the recording paper is jammed in the transport path.

Since the opening is provided in the top face of the case, when the user removes the recording paper, a foreign material such as a clip which unintentionally drops outside the case may enter the interior of the case. Also, in a configuration in which heavy goods such as a scanner is located on a top face of the image forming apparatus, there is a need to lift up the heavy goods such as the scanner in order to remove the jammed recording paper. This makes it difficult that the user accesses to a place where the recording paper is jammed through the opening.

It is therefore one advantageous aspect of the present invention to provide a recording apparatus in which accessibility to the jammed recording medium is improved and entrance of the foreign material when accessing to the jammed recording medium is prevented.

SUMMARY

According to a first aspect of the invention, there is provided a recording apparatus comprising:

a case;

a feeding unit, provided in the case, and configured to feed a recording medium in a feeding direction;

a feeding path, provided in the case, and through which the recording medium is fed;

a recording unit, provided in the case, and configured to record on the recording medium;

an ink tube, connected to the recording unit and an ink cartridge for supplying ink to the recording unit;

a first opening, provided in a face of the case for allowing the recording medium disposed in the feeding path to be removable;

a second opening, provided in the face where the first opening is provided for allowing the ink cartridge to be installed; and an operating unit, provided above the first opening.

In this case, a first placement unit configured to place the recording medium thereon may be provided below the first opening.

In this case, a discharging unit configured to discharge the recording medium may be provided between the first opening and the first placement unit.

In this case, the recording apparatus may further comprise a cover member configured to open and close the first opening.

In this case, a reader configured to read an image may be provided on a top face of the case.

In this case, the recording unit may include a carriage configured to move in a widthwise direction of the recording medium, and a protector for protecting the ink tube whose flexure is changed with movement of the carriage may be provided between the first opening and the feeding path.

In this case, the ink tube may be configured such that a size of an arc of the flexure is changed in accordance with the movement of the carriage, and a shape of the protector may be defined in accordance with a change of the size of the arc.

According to a second aspect of the invention, there is provided a recording apparatus comprising:

a case;

a feeding unit, provided in the case, and configured to feed a recording medium in a feeding direction;

a feeding path, provided in the case, and through which the recording medium is fed;

a recording unit, provided in the case, and configured to record on the recording medium;

an ink tube, connected to the recording unit and an ink cartridge for supplying ink to the recording unit;

a first opening, provided in a face of the case for allowing the recording medium disposed in the feeding path to be removable;

an operating unit, provided above the first opening;

a cover member, configured to open and close the first opening;

a reader, provided on a top face of the case, and configured to read an image.

In this case, a first placement unit configured to place the recording medium thereon may be provided below the first opening.

In this case, a discharging unit configured to discharge the recording medium may be provided between the first opening and the first placement unit.

In this case, a second opening may be provided in the face where the first opening is provided for allowing the ink cartridge to be installed, and the cover member may be configured to open and close the second opening.

In this case, the recording unit may include a carriage configured to move in a widthwise direction of the recording medium, and a screen member for screen the ink tube whose flexure is changed with movement of the carriage may be provided between the first opening and the feeding path.

In this case, the ink tube may be configured such that a size of an arc of the flexure is changed in accordance with the movement of the carriage, and a shape of the screen member may be defined in accordance with a change of the size of the arc.

According to a third aspect of the invention, there is provided a recording apparatus comprising:

a case;

a transport unit, provided in the case, and configured to transport a recording medium in a feeding direction;

a feeding path, provided in the case, and through which the recording medium is fed;

a recording unit, provided in the case, configured to record on the recording medium, and including a carriage configured to move in a widthwise direction of the recording medium;

a flexible member, connected to the recording unit, and a flexure thereof being changed with movement of the carriage;

an opening, provided in the case, and communicated with the feeding path; and a protector, provided between the first opening and the feeding path, and configured to protect the flexible member.

In this case, the flexible member may be a distributing cable.

According to a fourth aspect of the invention, there is provided a recording apparatus comprising:

a case;

a transport unit, provided in the case, and configured to transport a recording medium in a feeding direction;

a feeding path, provided in the case, and through which the recording medium is fed;

a recording unit, provided in the case, configured to record on the recording medium, and including a carriage configured to move in a widthwise direction of the recording medium;

a flexible member, connected to the recording unit, and a flexure thereof being changed with movement of the carriage;

an opening, provided in the case, and communicated with the feeding path; and a screen member, provided between the first opening and the feeding path, and configured to screen the flexible member.

In this case, the flexible member may be a distributing cable.

DESCRIPTION OF EXEMPLARY EMBODIMENTS

Exemplified embodiments of the invention are described below in detail with reference to the accompanying drawings.

Figure 1:
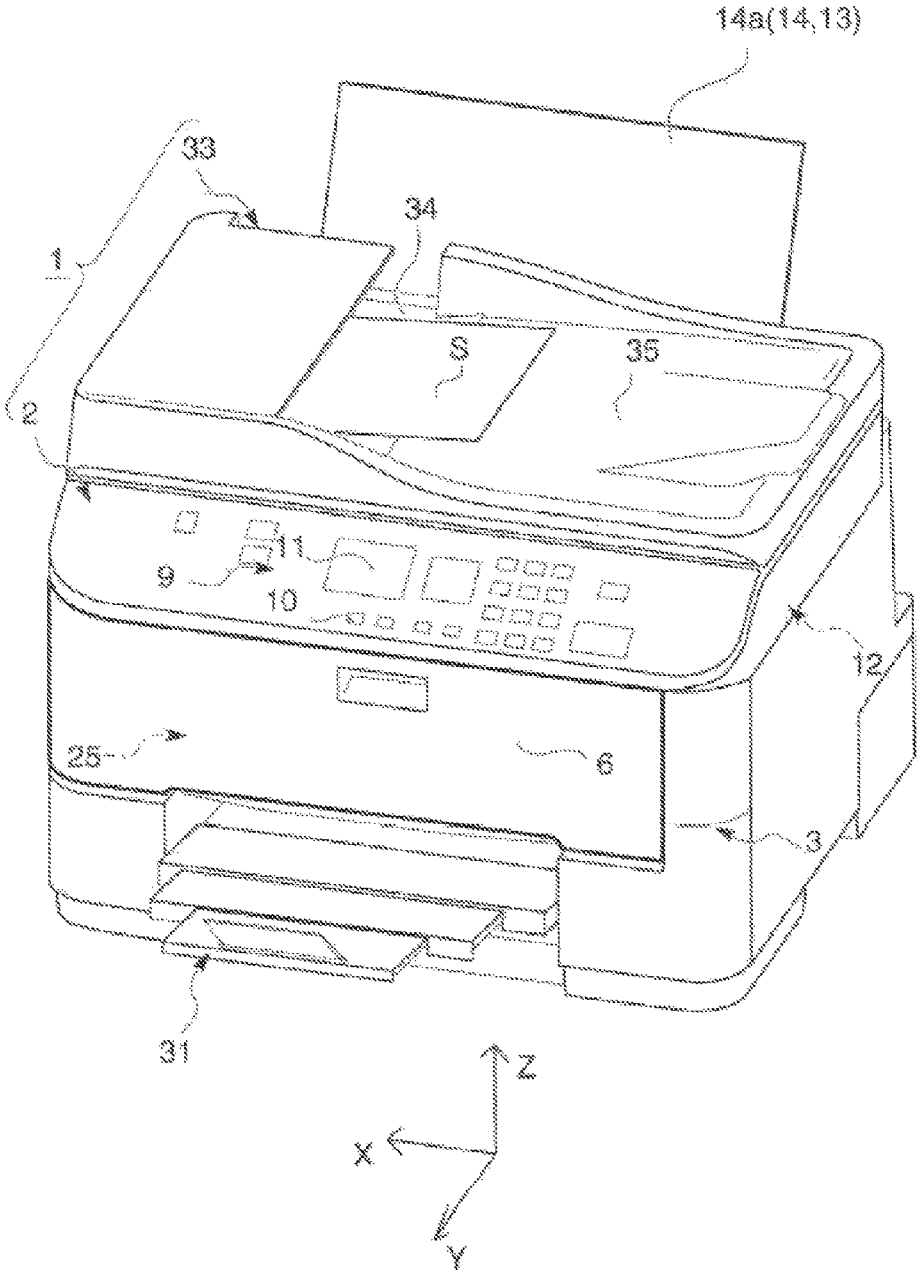
FIG. 1 is a front perspective view showing an entire of a printer in a state where a cover member is closed according to an embodiment of the invention.
Figure 2:
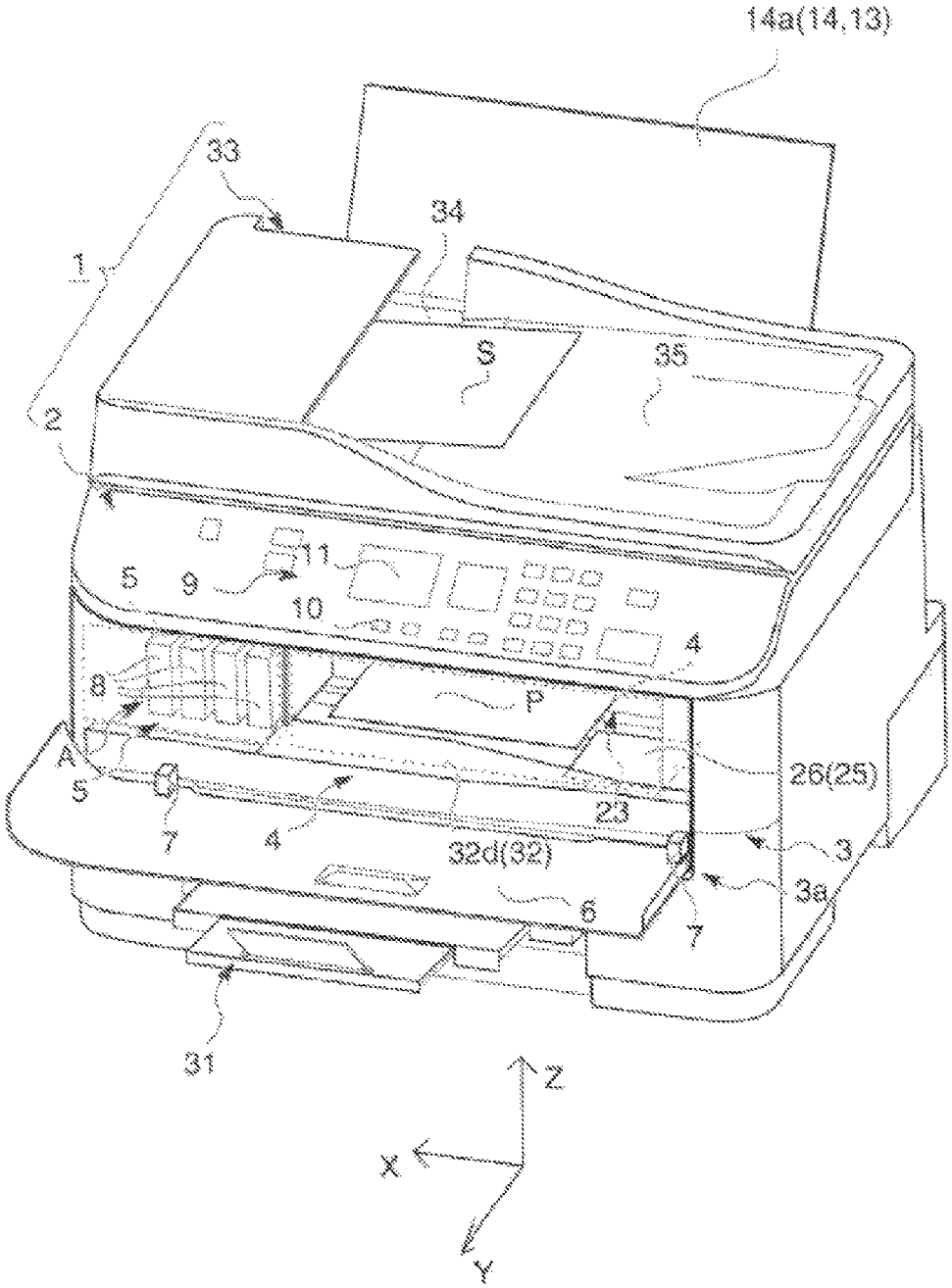
FIG. 2 is a front perspective view illustrating the entire of the printer in a state where the cover member is opened according to the embodiment.
Figure 3:
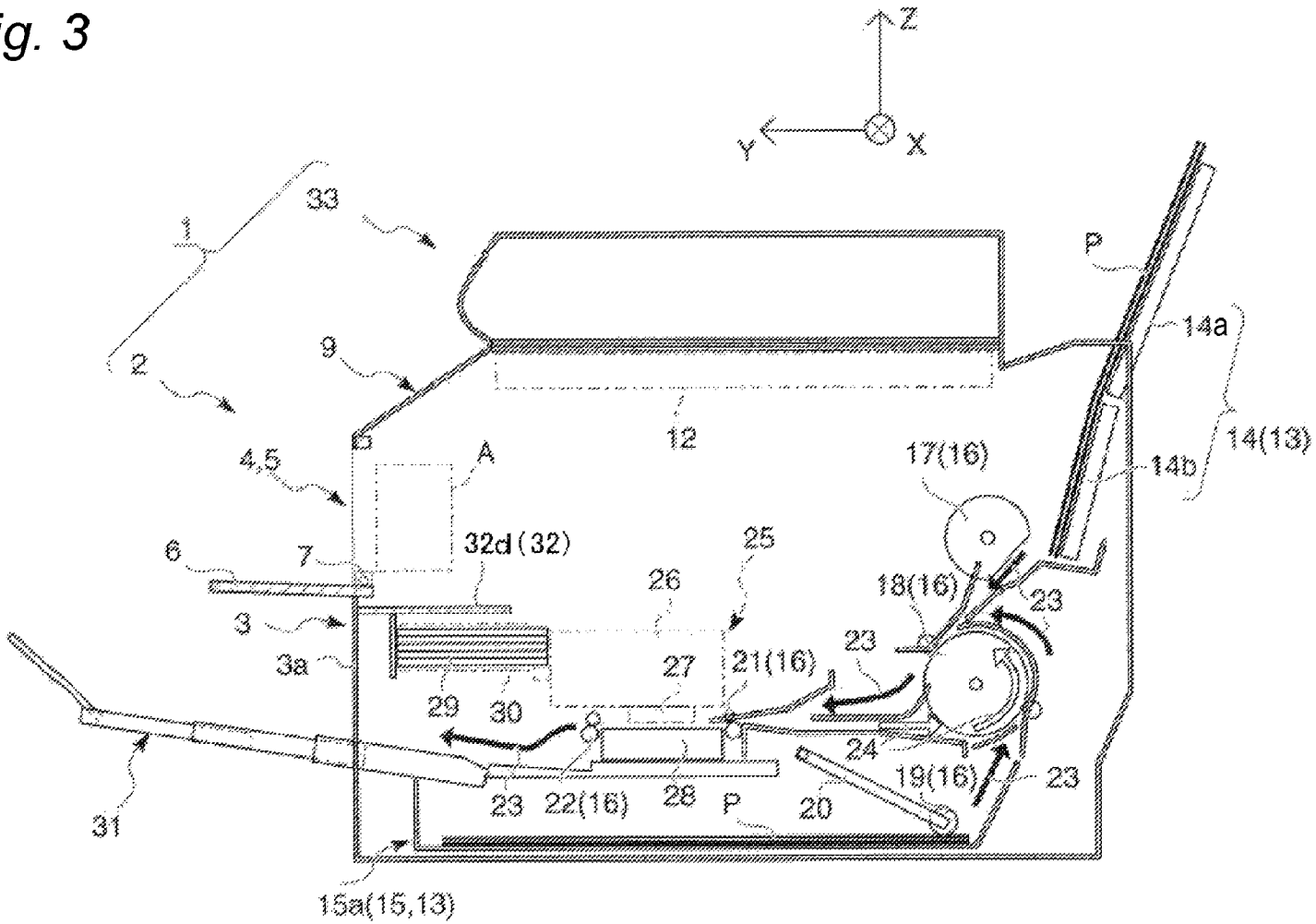
FIG. 3 is a side sectional view showing an outline of an interior of the printer according to the embodiment.

FIG. 1 is a front perspective view showing an entire of a multifunction printer 1 in a state where a cover member 6 is closed according to an embodiment of the present invention. FIG. 2 is a front perspective view showing the entire of the multifunction printer 1 in a state where the cover member 6 is opened according to the embodiment. FIG. 3 is a side sectional view showing an outline of an interior of the multifunction printer 1 according to the embodiment.

As illustrated in FIGS. 1 to 3, the multifunction printer 1 according to the embodiment includes a printer main body 2 and a medium transporting device 33. The printer main body 2 includes a scanner unit 12, an operating unit 9, a placement unit 13, a feeding unit 16, a feeding path 23, a recording unit 25, a first discharge stacker 31, a case 3, and a cover member 6.

The scanner unit 12 is provided on an upper side (direction indicated by an arrow of Z-axis) of the printer main body 2. The upper side is a side at which the medium transporting device 33 is provided with respect to the printer body 2. The Z-axis is a vertical direction.

The scanner unit 12 is a reader that reads an image, and so configured as to read information such as a photograph or a document which is recorded on a surface of a sheet S transported by the medium transporting device 33. Also, the operating unit 9 includes a display unit 11 and a button 10. The user conducts an operation of inputting an instruction through the button 10 and the display unit 11 so as to conduct a change in a setting condition of the multifunction printer 1 and to input various execution instructions.

In the embodiment, a side of the multifunction printer 1 on which the operating unit 9 is provided is a front side of the multifunction printer 1. The front side is a direction indicated by an arrow of Y-axis. That is, the operating unit 9 is provided on a front face (front face 3*a*) of the multifunction printer 1.

Furthermore, the placement unit 13 is so provided as to place a sheet P which is an example of the recording medium thereon. In the embodiment, the placement unit 13 includes a first placement unit 15 and a second placement unit 14. The first placement unit 15 has a cassette unit 15*a* detachably attached on a lower side of the printer main body 2. The second placement unit 14 has a paper support 14*a* and a hopper 14*b* which are provided on a back side of the printer main body 2. The back side is a side opposite to the front side of the multifunction printer 1. A lower side of the hopper 14*b* moves away from a first roller 17 around an upper side of the hopper 14*b* (direction indicated by the arrow of the Z-axis).

Also, the feeding unit 16 is provided to feed the sheet P placed on the placement unit 13 to the recording unit 25 in a feeding direction. The feeding direction may be a direction indicated by the arrow of Y-axis. The feeding unit 16 also performs as a transport unit that transports the sheet P. More specifically, the feeding unit 16 according to the embodiment includes the first roller 17, a second roller 18, a third roller 19, a first roller pair 21, and a second roller pair 22. When the lower side of the hopper 14*b* comes closer to the first roller 17, the first roller 17 comes in contact with the topmost sheet P so as to feed the sheet P to the second roller 18 on a downstream side in the feeding direction.

Also, the third roller 19 is provided on a free end of an arm unit 20 that can move in and out of contact with the cassette unit 15*a*. The third roller 19 is provided to contact the topmost sheet P in the cassette unit 15*a*, and feed the sheet P to the second roller 18 on a downstream side in the feeding direction.

Furthermore, the second roller 18 is provided to feed the sheet P fed by the first roller 17 and the third roller 19 to the first roller pair 21 on the further downstream side.

Also, the first roller pair 21 is provided to feed the sheet P to the recording unit 25 and the second roller pair 22 on the downstream side in the feeding direction at the time of recording. Furthermore, the second roller pair 22 is provided downstream side of the recording unit 25 in the feeding direction at the time of recording so as to discharge the sheet P recorded by the recording unit 25 to the first discharge stacker 31 performing as the discharge unit.

The feeding path 23 is a path through which the sheet P is fed, and is formed of a guide member. More specifically, the feeding path 23 is configured to guide the sheet P from the placement unit 13 to the first discharge stacker 31 via the recording unit 25.

Also, the recording unit 25 is configured to discharge ink to the sheet P fed by the feeding unit 16 so as to perform the recording. More specifically, the recording unit 25 includes a carriage 26, a recording head 27, and a medium support 28.

The carriage 26 is configured to travel while being guided by a guide member not shown which extends in a widthwise direction of the sheet P by a power of a motor not shown as an example. The widthwise direction is indicated by an arrow of X-axis. Also, the recording head 27 is provided on a side of the carriage 26 which faces the sheet P. Further, a face of the recording head 27 which faces the sheet P is formed with a nozzle (not shown) that discharges ink. Furthermore, the medium support 28 is provided at a position facing the recording head 27, and configured to keep a predetermined distance between the sheet P and the recording head 27.

Furthermore, the first discharge stacker 31 allows the recorded sheet P to be placed thereon. Also, the first discharge stacker 31 is expandable.

Apart from the feeding path 23, a reversal path 24 for reversing two sides of the sheet P is provided. In a two-sided recording mode, after a front face of the sheet P has been recorded, the sheet P is fed backward in a direction opposite to the feeding direction Y at the time of recording by the first roller pair 21 and the second roller pair 22. The sheet P is then fed to the reversal path 24, goes around the second roller 18 upward, and is again fed to the first roller pair 21. In this situation, the front surface already recorded faces the medium support 28 side, and a rear surface not yet recorded faces the recording head 27 side. The sheet P is then fed to the downstream side in the feeding direction at the time of recording by the first roller pair 21, and the rear surface is recorded by the recording unit 25.

Also, the case 3 is a housing of the printer main body 2. The case 3 is configured to cover the feeding path 23.

As illustrated in FIG. 2, in the embodiment, a first opening 4 is formed in the front face 3*a* of the case 3. The first opening 4 is provided above the cassette unit 15*a*. That is, the first opening 4 communicates with the feeding path 23 for the purpose of removing the jammed sheet P from the feeding path 23 when the sheet P is jammed in the feeding path 23. The user accesses to a place where the sheet P is jammed in the feeding path 23, close to the first roller pair 21 for example, from the first opening 4, and removes the jammed sheet P.

Also, the front face 3*a* of the case 3 in which the first opening 4 is formed is formed with a second opening 5 in which an ink cartridge 8 is installed. The ink cartridge 8 that supplies ink to the recording head 27 is fitted to a first predetermined position A which is a fitting position of the ink cartridge 8 in the interior of the case 3, and the second opening 5 is provided for exchanging the ink cartridge 8 with a fresh one. The user accesses to the first predetermined position A from the second opening 5, removes the empty ink cartridge 8 from the first predetermined position A, and fits another ink cartridge 8 (fresh ink cartridge) filled with ink to the first predetermined position A.

Furthermore, the cover member 6 is openably attached to the front face 3*a* of the case 3. Also, the cover member 6 is configured to open so that an upper (direction indicated by the arrow of the Z-axis) free end of the cover member 6 falls forward while rotating with respect to a pair of hinges 7. Further, in the embodiment, in a state where the cover member 6 is closed, the cover member 6 covers the first opening 4 and the second opening 5.

The medium transporting device 33 is arranged above the printer main body 2 in the direction indicated by the arrow of the Z-axis. Although the details will be omitted from the drawings, the medium transporting device 33 is provided to feed the sheet P placed on a third placement unit 34 at a second predetermined position facing the scanner unit 12 on the printer main body 2 side by a transport path (not shown). Then, image recorded on the surface of the sheet S is read by the scanner unit 12. Thereafter, the medium transporting device 33 feeds the sheet S to a second discharge stacker 35 so as to discharge the sheet S.

As shown in FIG. 2, in the embodiment, when the cover member 6 equipped on the front face 3*a* of the printer main body 2 is opened, the first opening 4 and the second opening 5 are exposed. Accordingly, the user can access to the sheet P from the first opening 4, and remove the jammed sheet P. Also, the user can replace the ink cartridge 8 with a fresh one. That is, the user can take measure against both of the jammed sheet and out-of-ink by merely opening the single cover member 6. As a result, as compared with a configuration in which the first opening 4 and the second opening 5 are covered with the different covers, the operability is improved. Also, the number of parts can be reduced, and the costs can be suppressed.

Also, as shown in FIG. 3, in order to supply ink from the ink cartridge 8 to the recording head 27 of the carriage 26, an ink tube 29 extending from a side of the ink cartridge 8 is connected to the carriage 26.

Furthermore, as illustrated in FIGS. 2 and 3, a shape 32*d* of a protector 32, which will be described in detail later, corresponding to a range B (refer to FIGS. 4 and 5) in which flexible members (29, 30) move, is provided on a path for accessing to the feeding path 23 from the first opening 4.

The shape 32*d* of the protector 32 is formed to cover an ink tube 29 connected to the carriage 26 when viewing an interior of the case 3 from an exterior of the case 3 through the first opening 4. Accordingly, the user can be prevented from touching the ink tube 29 with his hand when the user reaches his hand from the first opening 4 to access to the feeding path 23. As a result, there is no case in which the user's hand is contaminated with, for example, an ink mist attached to the ink tube 29. Also, there is no case in which the ink tube 29 is damaged, and no case in which the ink tube 29 is withdrawn from the carriage 26. Furthermore, there is no case in which a distribution cable 30 such as a flat cable which is drawn around as with the ink tube 29 is withdrawn from the carriage 26. The protector 32 performs as a screen member for screening the ink tube 29.

Also, the first opening 4 according to the embodiment is provided in the front face 3*a* of the case 3 in the printer main body 2. Accordingly, even when the user drops a foreign material such as a clip outside the case 3 in opening the cover member 6 and removing the jammed sheet P, the foreign material does not enter the interior of the case.

Furthermore, according to the embodiment, the scanner unit 12 is provided on the top face of the printer main body 2. The first opening 4 according to the embodiment is provided in the front face 3*a* of the case 3 in the printer main body 2, and therefore the user does not need to swing the relatively heavy scanner unit 12 upward (direction of the arrow of the Z-axis). As a result, the user can easily access to a place of the feeding path 23 where the jammed sheet P is located.

Also, with provision of the first opening 4 in the front face 3*a* of the case 3, the user can access to the upstream side from the downstream side in the feeding direction of the sheet P when removing the jammed sheet P. In this example, when the opening is provided in the top face, the opening is normally largely so provided as to make a face of the sheet P observable over a wide area. Accordingly, as compared with provision of the first opening 4 in the top face, when the first opening 4 is provided in the front face 3*a* of the case 3, a size of the first opening 4 can be reduced.

The strength of the case 3 can be enhanced as much as the size of the first opening 4 is reduced. As a result, the strength of the case 3 is not short.

Furthermore, since the cover member 6 is so opened as to fall forward, the opening and closing operation of the cover member 6 is not prevented by the scanner 12 or the medium transporting device 33 provided on the top face of the case. Further, as compared with a configuration in which the lower end of the cover is opened upward, the user can easily observe the interior of the case 3 through the first opening 4 because the observation is not prevented by the opened cover member 6.

Subsequently, the protector 32 will be described in more detail.

Figure 4:
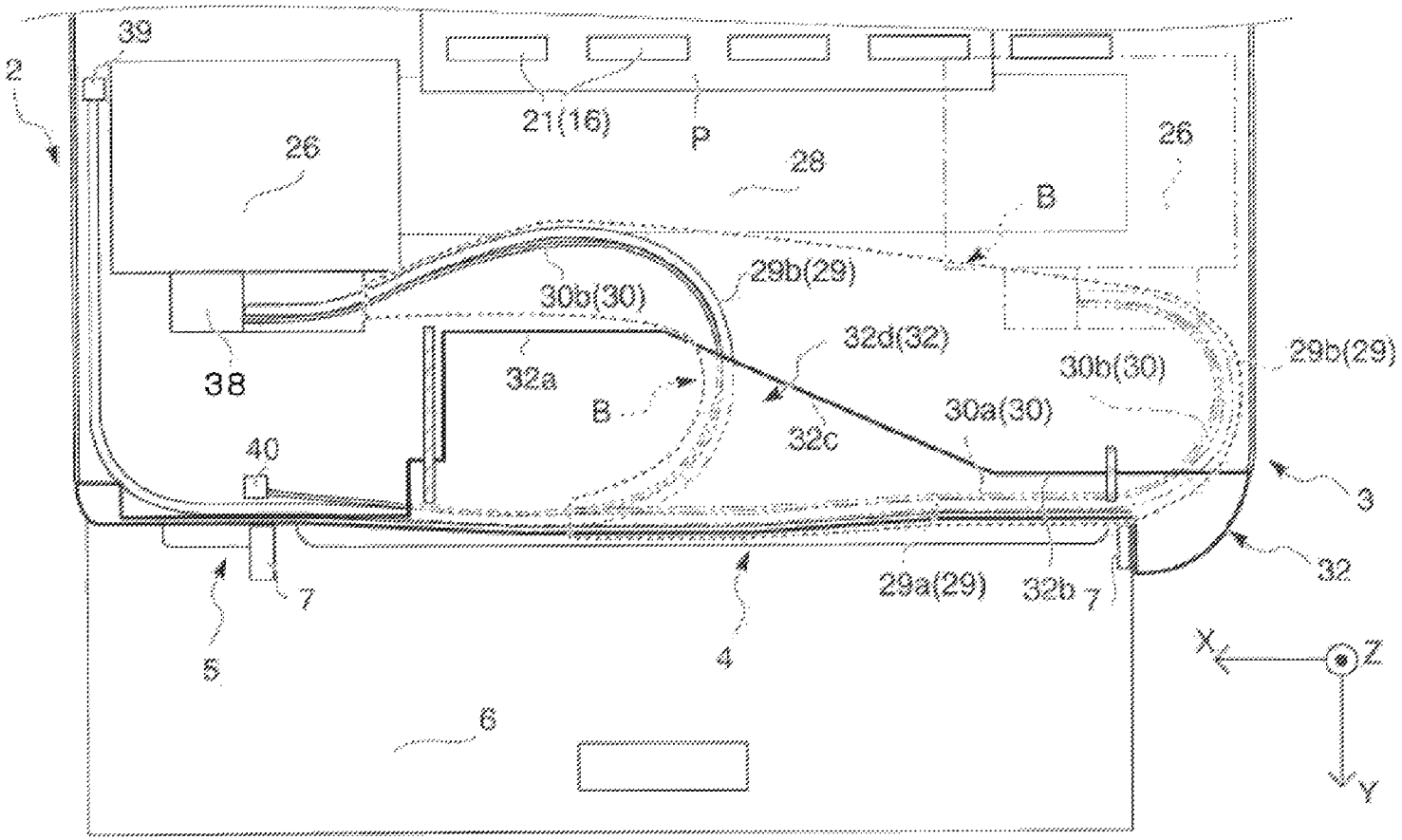
FIG. 4 is a plane sectional view showing the outline of the interior of the printer according to the embodiment.
Figure 5:
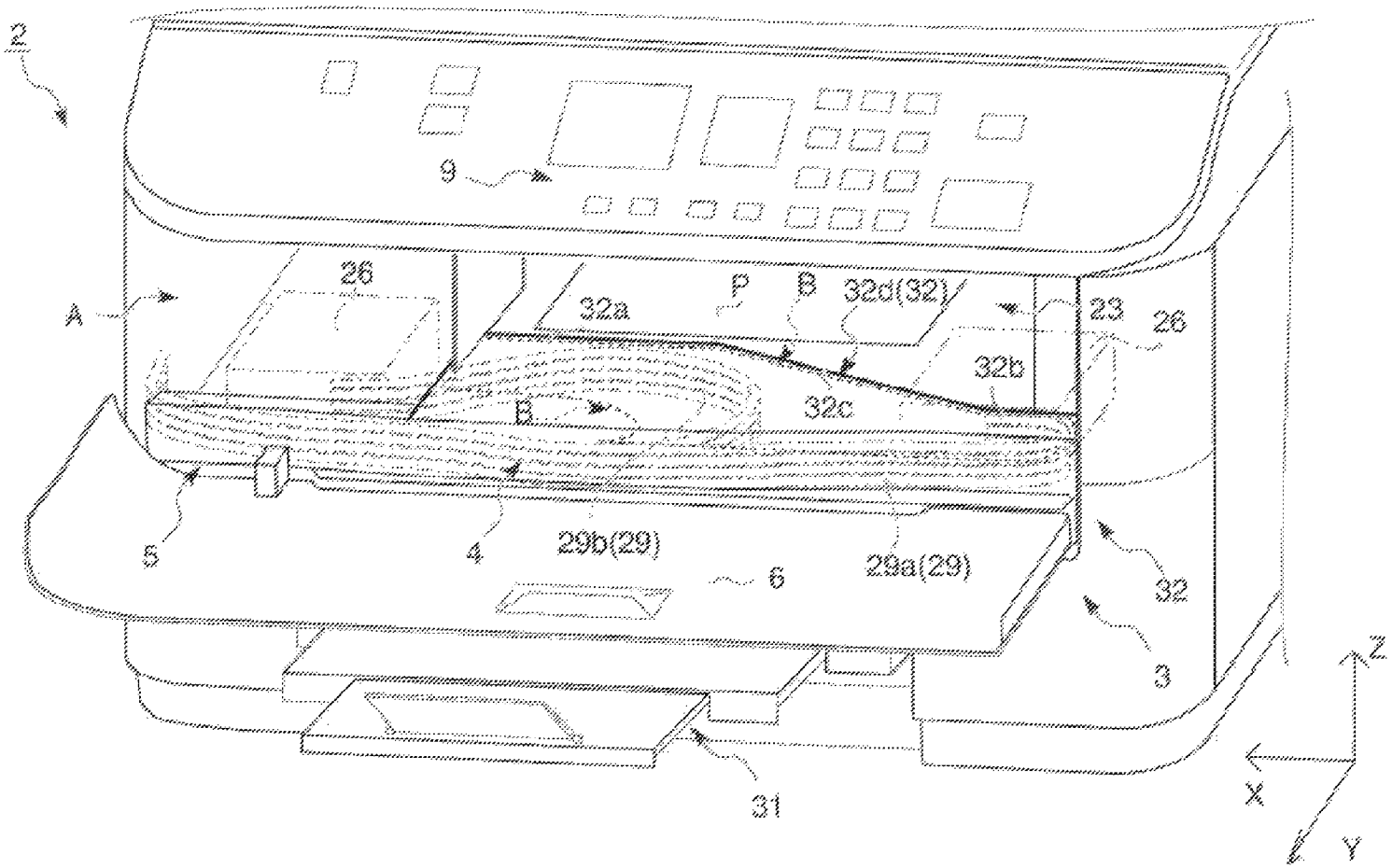
FIG. 5 is a perspective view of the printer when viewed from an exterior of a case toward an interior thereof through a first opening.

FIG. 4 is a plan sectional view showing the outline of the interior of the printer according to the embodiment. Also, FIG. 5 is a perspective view of the printer when viewed from the exterior of the case 3 toward the interior thereof through the first opening 4. In order to facilitate understanding the position and shape of the ink tube 29, a first connection 38, a second connection 39, a third connection 40 and the distribution cable 30 are omitted from FIG. 5.

As shown in FIGS. 4 and 5, the inside of the case 3 in the first opening 4 is equipped with the above-mentioned protector 32. The protector 32 has the shape 32*d* corresponding to the range B in which the ink tube 29 and the distribution cable 30 which are examples of the flexible members move.

In the embodiment, the carriage 26 is provided to be movable in the widthwise direction X of the sheet P. Also, the first connection 38 that is the carriage 26 side and the fixed second connection 39 that is the ink cartridge 8 side are connected by the ink tube 29. This is because ink in the ink cartridge 8 is supplied to the recording head 27 on the carriage 26 side as described above.

Also, the first connection 38 on the carriage 26 side and the third connection 40 fixed to the same side as a side on which the second connection 39 is provided in the widthwise direction X are connected by the distribution cable 30. This is because an electric signal for discharging ink from the nozzle is transmitted to the recording head 27 on the carriage 26 side from a controller not shown.

Also, portions 29*a* and 30*a* of the ink tube 29 and the distribution cable 30 are connected along the inside of the case 3 at a position lower than the cover member 6. Furthermore, portions 29*b* and 30*b* of the ink tube 29 and the distribution cable 30 between the portions 29*a* and 30*a* extending along the inside of the case 3, and the first connection 38 of the carriage 26 are bent to draw arcs.

In the embodiment, when the carriage 26 is located on a downstream end (left side in FIG. 4) in an arrow of an X-axis in a range where the carriage 26 is movable in the X-axial direction, the portions 29*b* and 30*b* of the ink tube 29 and the distribution cable 30 therebetween are bent to draw the arcs large in diameter (solid line and dashed line in FIG. 4).

When the carriage 26 moves from the downstream side to the upstream side in the arrow of the X-axis in the range where the carriage 26 is movable, parts of the portions 29*b* and 30*b* of the ink tube 29 and the distribution cable 30 therebetween are deformed along the inside of the case 3 with move of the carriage 26.

That is, a rate of the portions 29*a* and 30*a* of the ink tube 29 and the distribution cable 30 disposed along the inside of the case 3 is increased. On the other hand, a rate of the portions 29*b* and 30*b* therebetween which are bent to draw the arcs is decreased, and diameters of the arcs of the portions 29*b* and 30*b* of the ink tube 29 and the distribution cable 30 therebetween are decreased.

When the carriage 26 moves to the upstream end (right side in FIG. 4) in the arrow of the X-axis in the range where the carriage 26 is movable in the X-axial direction, the portions 29*b* and 30*b* of the ink tube 29 and the distribution cable 30 therebetween are bent to draw the arcs small in diameter (long dashed double-short dashed line in FIG. 4).

On the contrary, when the carriage 26 moves from the upstream side to the downstream side in the arrow of the X-axis in the range where the carriage 26 is movable, the parts of the portions 29*a* and 30*a* of the ink tube 29 and the distribution cable 30 therealong are deformed to be away from the inside of the case 3. That is, the rate of the portions 29*a* and 30*a* of the ink tube 29 and the distribution cable 30 along the inside of the case 3 is decreased.

On the other hand, the rate of the portions 29*b* and 30*b* therebetween which are bent to draw the arcs is increased, and the diameters of the arcs of the portions 29*b* and 30*b* of the ink tube 29 and the distribution cable 30 therebetween are decreased.

When the carriage 26 moves to the downstream end (left side in FIG. 4) in the arrow of the X-axis in the range where the carriage 26 is movable in the X-axial direction, the portions 29*b* and 30*b* of the ink tube 29 and the distribution cable 30 therebetween are bent to draw the arcs large in diameter (solid line and long dashed short dashed line in FIG. 4).

Thus, with movement of the carriage 26, while the positions of the ink tube 29 and the distribution cable 30 on the first connection 38 side move, the flexures of the ink tube 29 and the distribution cable 30 are changed. In this situation, the protector 32 has the shape 32*d* corresponding to the movable range B of the ink tube 29 and the distribution cable 30. In other words, the shape 32*d* of the protector 32 is defined in accordance with a change of the size of the arcs of the ink tube 29 and the distribution cable 30.

More specifically, the corresponding shape 32*d* of the protector 32 is configured so that the portion 32*a* on the downstream side in the arrow of the X-axis in the widthwise direction X extends upstream of the portion 32*b* on the upstream side in the arrow of the X-axis, in an arrow of the Y-axis. With this shape, as shown in FIG. 5, when the interior of the case 3 is viewed from the external of the case 3 through the first opening 4 at least in front of the multifunction printer 1, the ink tube 29 and the distribution cable 30 can be always covered or screened with the protector 32 regardless of the position of the carriage 26.

As usual, in a state where the multifunction printer 1 stops, that is, in a state where recording is not presently executed including a case in which the sheet P is jammed, the carriage 26 is located on any one of the downstream end and the upstream end in the arrow of the X-axis in the movable range. Accordingly, when the sheet P is jammed, the user can open the cover member 6, reach his hand for a place in which the jammed sheet P is located from the first opening 4, and remove the jammed sheet P.

In this situation, as described above, the user can be prevented from touching the ink tube 29 with his hand. As a result, the user's hand is prevented from being contaminated with, for example, the ink mist attached to the ink tube 29. Also, the ink tube 29 is prevented from being damaged, and the ink tube 29 is prevented from being withdrawn from the carriage 26. Furthermore, there the distribution cable 30 which is drawn around as with the ink tube 29 is prevented from being withdrawn from the carriage 26.

Also, in the corresponding shape 32*d* of the protector 32, the portion 32*b* on the upstream side in the arrow of the X-axis in the widthwise direction X is shorter in a distance extending toward the upstream side in the arrow of the Y-axis than the portion 32*a* on the downstream side in the arrow of the X-axis. Accordingly, the user can easily reach his hand from the upstream side in the arrow of the X-axis in the widthwise direction X toward the upstream side in the axis of the Y-axis, and surely reaches his hand for a place in which the jammed sheet P is located, to a location close to the first roller pair 21 for example. That is, both of the prevention of the user's hand from touching the ink tube 29 and the distribution cable 30, and the accessibility to the jammed sheet P can be achieved.

Also, with provision of the corresponding shape 32*d* of the protector 32, the user's hand can be resultantly prevented from touching an edge of a sheet-metal member provided inside of the case 3, and getting injured.

As described above, the protector 32 is effective in a case where the carriage 26 stops at any position of the downstream end and the upstream end in the arrow of the X-axis in the movable range. However, the stop position is not limited to the downstream end and the upstream end in the arrow of the X-axis in the movable range. Even when the carriage 26 stops between the downstream end and the upstream end in the arrow of the X-axis in the movable range for some reasons, the ink tube 29 and the distribution cable 30 are always covered with the corresponding shape 32*d* of the protector 32. Even in this case, the configuration having the protector 32 is effective.

Also, an end 32*c* of the corresponding shape 32*d* of the protector 32 on the upstream side in the arrow of the Y-axis is configured to have an obtuse angle but no acute angle. With this configuration, the user's hand is not caught by the protector 32. Furthermore, as described above, the protector 32 has only to have the shape 32*d* corresponding to the range B in which the flexible member connected to the carriage 26 moves with move of the carriage 26, and may have any shape as a whole. For example, the protector 32 may be shaped to form a part of the case 3. That is, the protector 32 may be formed to include the part of the case 3 as a whole.

Although only some exemplary embodiments of the invention have been described in detail above, those skilled in the art will readily appreciated that many modifications are possible in the exemplary embodiments without materially departing from the novel teachings and advantages of the invention. Accordingly, all such modifications are intended to be included within the scope of the invention.

In the above embodiment, the ink cartridge 8 is fitted to the predetermined position A in the interior of the case 3. Alternatively, ink may be supplied to the carriage 26 in the interior of the case 3 from an ink tank provided in the exterior of the case 3, separately.

The present application is based on Japanese Patent Applications No. 2011-042306 filed on Feb. 28, 2011 and No. 2011-042315 filed on Feb. 28, 2011, the contents of which are incorporated herein by way of reference.

What is claimed is:

1. A recording apparatus comprising:

a case;

a feeding unit, provided in the case, and including a feeding roller configured to feed a recording medium placed on a cassette unit in a feeding direction;

a feeding path, provided in the case, and through which the recording medium is fed;

a recording unit, provided in the case, and configured to record on the recording medium;

an ink tube, connected to the recording unit and an ink cartridge for supplying ink to the recording unit;

a first opening, provided in a face of the case which is orthogonal to the feeding direction, and allowing the recording medium disposed in the feeding path to be removable;

a cover member, configured to open and close the first opening;

a second opening, provided in the face where the first opening is provided, and allowing the ink cartridge to be installed;

a protector extending from the first opening to inside of the case at a position higher than the ink tube so as to overlap the ink tube; and an operating unit, provided above the first opening, wherein:

the protector is arranged at a position higher than both the ink tube and the feeding roller of the feeding unit.

2. The recording apparatus according to claim 1, wherein a first placement unit configured to place the recording medium thereon is provided below the first opening.

3. The recording apparatus according to claim 2, wherein a discharging unit configured to discharge the recording medium is provided between the first opening and the first placement unit.

4. The recording apparatus according to claim 1, wherein a reader configured to read an image is provided on a top face of the case.

5. The recording apparatus according to claim 1, wherein the recording unit includes a carriage configured to move in a widthwise direction of the recording medium, and the protector is configured to protect the ink tube whose flexure is changed with movement of the carriage, wherein the protector is provided between the first opening and the feeding path.

6. The recording apparatus according to claim 5, wherein the ink tube is configured such that a size of an arc of the flexure is changed in accordance with the movement of the carriage, and a shape of the protector is defined in accordance with a change of the size of the arc.

7. A recording apparatus comprising:

a case;

a feeding unit, provided in the case, and including a feeding roller configured to feed a recording medium placed on a cassette unit in a feeding direction;

a feeding path, provided in the case, and through which the recording medium is fed;

a recording unit, provided in the case, and configured to record on the recording medium;

an ink tube, communicated with the recording unit and an ink supply source for supplying ink to the recording unit;

a first opening, provided in a face of the case which is orthogonal to the feeding direction, and allowing the recording medium disposed in the feeding path to be removable;

a protector extending from the first opening to inside of the case at a position higher than the ink tube so as to overlap the ink tube;

an operating unit, provided above the first opening;

a cover member, configured to open and close the first opening;

a reader, provided on a top face of the case, and configured to read an image, wherein:

the protector is arranged at a position higher than both the ink tube and the feeding roller of the feeding unit.

8. The recording apparatus according to claim 7, wherein a first placement unit configured to place the recording medium thereon is provided below the first opening.

9. The recording apparatus according to claim 8, wherein a discharging unit configured to discharge the recording medium is provided between the first opening and the first placement unit.

10. The recording apparatus according to claim 7, wherein a second opening is provided in the face where the first opening is provided for allowing an ink cartridge to be installed, and the cover member is configured to open and close the second opening.

11. The recording apparatus according to claim 7, wherein the recording unit includes a carriage configured to move in a widthwise direction of the recording medium, and a screen member for screening the ink tube whose flexure is changed with movement of the carriage is provided between the first opening and the feeding path.

12. The recording apparatus according to claim 11, wherein the ink tube is configured such that a size of an arc of the flexure is changed in accordance with the movement of the carriage, and a shape of the screen member is defined in accordance with a change of the size of the arc.

13. The recording apparatus according to claim 7, further comprising:

a reader, provided on a top face of the case, and configured to read an image.

14. The recording apparatus according to claim 7, wherein the protector is positioned above the feeding path.

15. A recording apparatus comprising:

a case;

a transport unit, provided in the case, and configured to transport a recording medium in a feeding direction;

a feeding path, provided in the case, and through which the recording medium is fed;

a recording unit, provided in the case, configured to record on the recording medium, and including a carriage configured to move in a widthwise direction of the recording medium;

a flexible member, connected to the recording unit, and having a flexure being changed with movement of the carriage;

a first opening, provided in a face of the case which is orthogonal to the feeding direction, and communicated with the feeding path; and a protector, provided between the first opening and the feeding path and extending from the first opening to inside of the case at a position higher than the flexible member so as to overlap the flexible member, wherein the first opening is on a first side of the protector and the flexible member is on a second side of the protector than the first side and the protector is configured to protect the flexible member, the transport unit includes a first roller at an upstream side with respect to a region of the feeding path where the recording unit moves and a second roller at a downstream side with respect to the region so that the region is disposed between the first roller and the second roller, and the protector is arranged at a position higher than the flexible member and the first roller and the second roller of the transport unit.

16. The recording apparatus according to claim 15, wherein the flexible member is a distributing cable.

17. A recording apparatus comprising:

a case;

a transport unit, provided in the case, and configured to transport a recording medium in a feeding direction;

a feeding path, provided in the case, and through which the recording medium is fed;

a recording unit, provided in the case, configured to record on the recording medium, and including a carriage configured to move in a widthwise direction of the recording medium;

a flexible member, connected to the recording unit, and having a flexure being changed with movement of the carriage;

a first opening, provided in a face of the case which is orthogonal to the feeding direction, and communicated with the feeding path; and a screen member, provided between the first opening and the feeding path and extending from the first opening to the inside of the case at a position higher than the flexible member so as to overlap the flexible member, wherein the first opening is on a first side of the screen member and the flexible member is on a second side of the protector than the first side and wherein the screen member is and configured to screen the flexible member, the transport unit includes a first roller at an upstream side with respect to a region of the feeding path where the recording unit moves and a second roller at a downstream side with respect to the region so that the region is disposed between the first roller and the second roller, and the screen member is arranged at a position higher than the flexible member and the first roller and the second roller of the transport unit.

18. The recording apparatus according to claim 17, wherein the flexible member is a distributing cable.

19. A recording apparatus comprising:

a case;

a feeding unit, provided in the case, and including a feeding roller configured to feed a recording medium placed on a cassette unit in a feeding direction;

a feeding path, provided in the case, and through which the recording medium is fed;

a recording unit, provided in the case, configured to record on the recording medium, and including a carriage configured to move in a widthwise direction of the recording medium;

an ink tube, communicated with the recording unit and an ink supply source for supplying ink to the recording unit, and having a flexure being changed with movement of the carriage;

a first opening, provided in a face of the case which is orthogonal to the feeding direction, and communicated with the feeding path; and a protector extending from the first opening to inside of the case at a position higher than the ink tube so as to overlap the ink tube, wherein the protector is arranged at a position higher than both the ink tube and the feeding roller of the feeding unit.

* * * * *